US005437374A

United States Patent [19]

Bills et al.

[11] Patent Number: 5,437,374

[45] Date of Patent: Aug. 1, 1995

[54] ADJUSTABLE ORIFICE TROMMEL

[75] Inventors: Marlin D. Bills, Bixby, Okla.; Ron Chandler, East Peoria, Ill.

[73] Assignee: Osborn Engineering, Inc., Tulsa, Okla.

[21] Appl. No.: 97,689

[22] Filed: Jul. 23, 1993

[51] Int. Cl.[6] ..... B07B 1/22; B07B 1/49

[52] U.S. Cl. ..... 209/288; 209/398; 209/683

[58] Field of Search ..... 209/274, 284, 288, 397, 209/398, 279, 399, 680, 683

[56] References Cited

U.S. PATENT DOCUMENTS

| | | | |
|---|---|---|---|
| 121,192 | 11/1871 | Page | 209/398 |
| 560,586 | 5/1896 | Koch | 209/398 |
| 667,168 | 1/1901 | Sorenson | 209/398 |
| 775,755 | 11/1904 | Larson | 209/398 X |
| 908,618 | 1/1909 | Skagen | 209/398 |
| 1,143,231 | 6/1915 | Schaefer | 209/284 |
| 1,839,532 | 1/1932 | Calhoun | 209/398 X |
| 1,847,193 | 3/1932 | Peters | 209/398 X |
| 2,315,651 | 4/1943 | Peterson | 209/398 |
| 2,355,050 | 8/1944 | Borton | 209/288 X |
| 2,520,718 | 8/1950 | Hanson | 209/398 X |
| 3,524,661 | 8/1970 | Farnam | 285/239 |
| 3,712,114 | 1/1973 | Osborn | 55/270 X |
| 3,865,561 | 2/1975 | Osborn | 55/270 X |
| 4,329,161 | 5/1982 | Osborn | 55/302 X |
| 4,361,239 | 11/1982 | Kumandan | 209/288 X |

FOREIGN PATENT DOCUMENTS

| | | | |
|---|---|---|---|
| 0205518 | 1/1909 | Germany | 209/398 |

*Primary Examiner*—William E. Terrell
*Assistant Examiner*—Tuan N. Nguyen
*Attorney, Agent, or Firm*—Head & Johnson

[57] ABSTRACT

An adjustable orifice trommel having an elongated body rotatable about an axis, an entry for insertion of particulate material, and an exit for retrieving screened material. The trommel includes a plurality of flat inner plates, each inner plate having a plurality of openings. An outer plate is provided for each inner plate slidable axially in relation to the inner plate, each outer plate having a plurality of openings matable with the inner plate openings so that moving the outer plate with respect to the inner plate will vary the size of the orifices.

7 Claims, 6 Drawing Sheets

ADJUSTABLE ORIFICE TROMMEL

BACKGROUND OF THE INVENTION

1. Field of the Invention

The present invention is directed to a rotating trommel for screening or filtering material of different sizes. In particular, the present invention is directed to a rotating trommel wherein the openings or orifices are variable in size.

2. Prior Art

The use of trommels to screen or filter particulate material to separate material under a chosen size is well known. One type of trommel is a substantially cylindrical trommel having openings or orifices in the walls. The trommel is rotated about its cylindrical axis so that the force of gravity causes the material to tumble within the trommel. Particles smaller than the size of the openings will fall through the openings and be separated out.

One application for such trommels is in metal recycling systems. The recovery of valuable metals from waste effluents is increasingly important since there are only two options for managing such wastes disposal or recycling.

Recovery of valuable metals by recycling waste automobiles is one metal recycling usage. Waste automobiles are initially shredded and the particulate material is separated for recycling. The automobiles are initially shredded and then processed to separate ferrous (magnetic) material from nonferrous (nonmagnetic) material by use of a magnetic separation unit.

The nonferrous residue is known to contain a small percentage of nonferrous metallics. The percentage of nonferrous metallics in the nonferrous stream ranges from 30 percent up to 65 percent. The nonferrous metallics include aluminum, zinc, copper, brass and stainless steel.

The non-metal remaining material typically includes plastic, fluff, coated electrical wire, rubber, rock and glass particles.

To increase the quality of the nonferrous metallics in the residue, the residue is often passed through a rotating screen trommel.

The trommel itself is rotated about its axis so that the materials will move upward in response to the trommel and they will fall back down by force of gravity. Ideally, the nonferrous material will tumble a number of times as it passes through the tube. Presently, internally extending strike plates are utilized as an example, the trommel may be provided with openings to allow material less than ½ inch in size to fall through. Depending on the waste material being processed, it may be desirable to vary the size of the orifices in the trommel.

There is a need to provide a trommel wherein the particulate matter will be tumbled by rotation of the trommel and force of gravity.

There is additionally a need to provide a trommel wherein the size of the orifices and, therefore, the size of the materials separated, is variable.

SUMMARY OF THE INVENTION

The present invention is directed to an adjustable orifice trommel used for screening or filtering a mixture of particulate material of different sizes. The trommel includes an elongated body which is rotatable about an axis. The body is substantially hollow for receipt of the particulate matter. An entry at one end of the body allows insertion of particulate matter and an exit at the opposite end of the body allows for removal of the remaining material after the screening process.

The elongated body and its axis are a slight decline so that material in the trommel will tend to move from entry to exit by force of gravity. The orifice trommel is rotated about its axis so that the material comes into frequent contact with the body trommel.

The elongated body includes a plurality of flat inner plates connected along their edges to form the continuous wall of the body. Eight flat inner plates combine to form an octagon. Each inner plate includes a plurality of aligned openings arranged in rows.

Each inner plate has a corresponding, overlaid, flat, outer plate which includes a plurality of outer plate openings having dimensions the same as the inner plate openings. The outer plate openings are aligned in one orientation to mate with the inner plate openings to form a plurality of orifices.

The outer plate is allowed to slide axially along the axis of the body. A series of threaded posts extend vertically outward from the inner plate. A clamp bar, having an opening fitting over the post, is held in place by a threaded nut. Tightening the nut will clamp the bar down on the outer plate and secure it in the desired position.

In one embodiment, the outer plate will move with respect to the inner plate across square openings from corner to corner. In any position of the outer plate, the orifice openings remain square shaped.

By use of the present invention, the orifices can be mechanically adjusted to a desired size at the user's discretion.

DETAILED DESCRIPTION OF THE PREFERRED EMBODIMENTS

Figure 1:
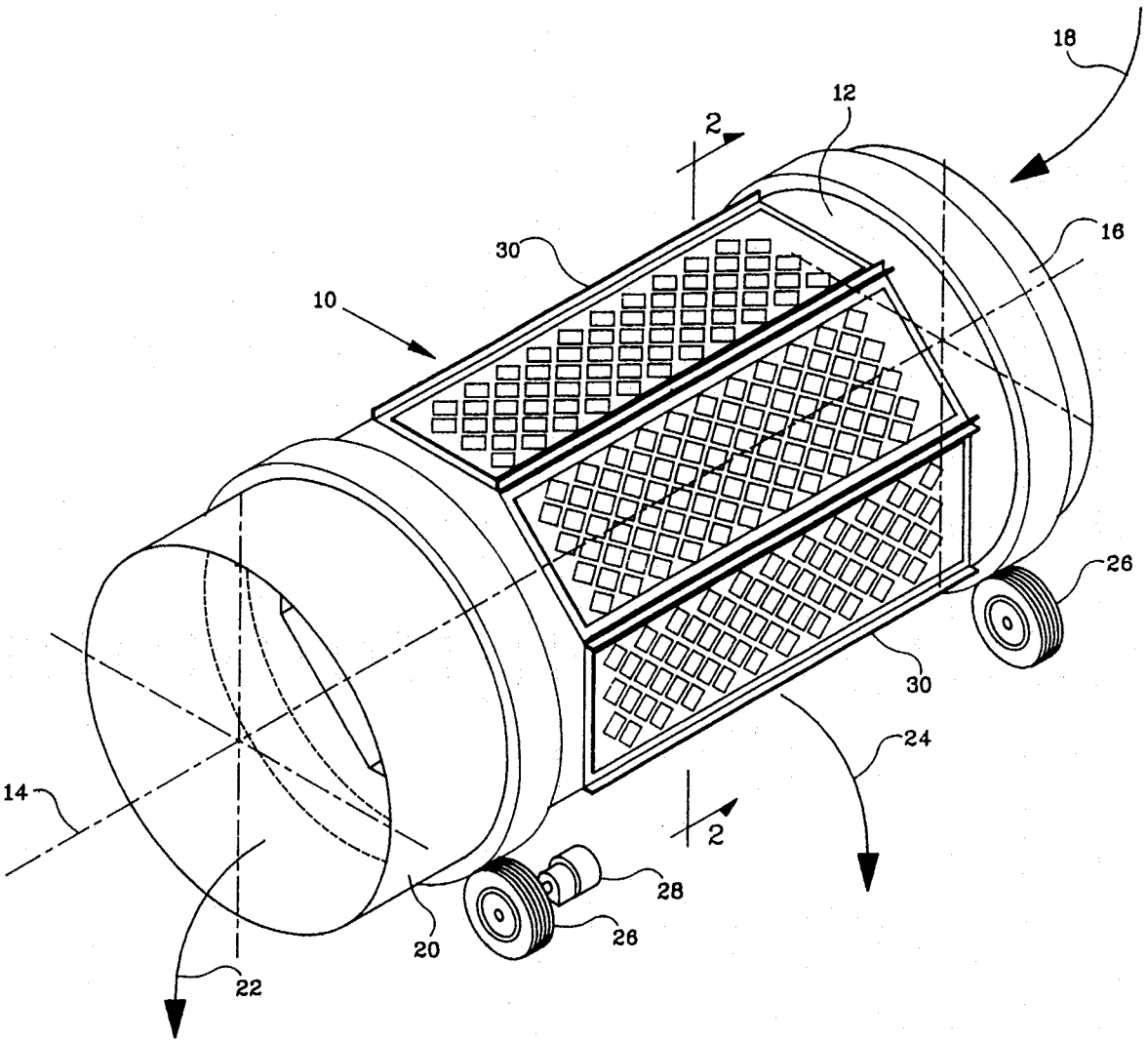
FIG. 1 is a perspective view of an adjustable orifice trommel constructed in accordance with the present invention.

Referring to the drawings in detail, FIG. 1 illustrates a perspective view of an adjustable orifice trommel 10. The trommel is utilized for screening or filtering a mix or mixture of particulate material (not shown) of different sizes.

One use of the present invention is in separating materials for recycling of waste products.

The trommel 10 includes an elongated body 12 having an axis 14, illustrated by dashed lines. The elongated body is substantially hollow for receipt of the particulate matter. The mixture of particulate matter to be filtered, screened or separated, is inserted in an entry 16 (illustrated by arrow 18) at one end of the body. After the material has been processed in the trommel 10, the remaining material will be removed through an exit 20 at the opposite end of the body illustrated by arrow 22.

The particles in the material that are smaller than the size of the orifices sometimes referred to as "fines," will fall out or be screened to a receptacle (not shown) as illustrated by arrow 24.

It will be understood that the trommel of the present invention may be used with various components as a part of a process, such as transport conveyors to deliver the waste material to be processed and take-away conveyors and hoppers.

The elongated body 12 is on a slight decline from the entry 16 to the exit 20 so that the axis will, thus, be on a slight decline. The material in the trommel will tend to move from the entry to the exit by force of gravity. The body 12 of the orifice trommel 10 is rotated about its axis 14 by a pair of wheels 26 which frictionally engage the body 12. The wheels 26 are rotated by a motor 28 or a pair of motors.

The elongated body 12 includes a plurality of flat inner plates 30. The inner plates are connected along their edges to form the interior wall of the body 12. In the present embodiment, eight flat inner plates 30 form an octagon as most clearly seen in the sectional view shown in FIG. 2. While the present embodiment utilizes eight adjoining panels, it will be recognized that a lesser or greater number may be employed.

Each inner plate 30 includes a plurality of aligned openings 32 arranged in rows. Each inner plate opening 32 has four equal sides at right angles to each other in order to form a square opening. The angles of each opening are adjacent the angles of the other openings.

Figure 3:
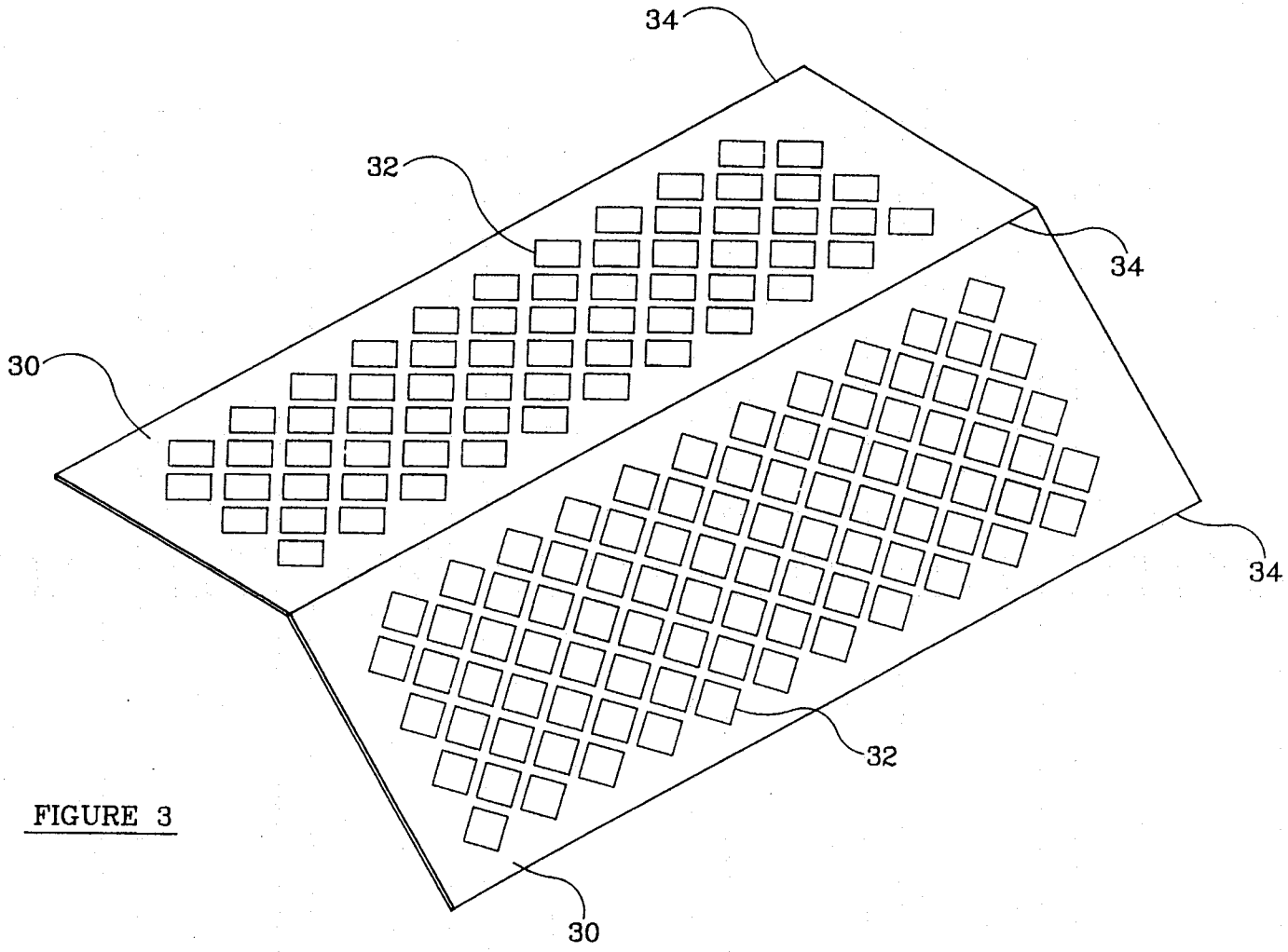
FIG. 3 is a perspective view of the flat inner plates of the adjustable orifice trommel shown in FIG. 1.

FIG. 3 shows a pair of the inner plates 30 apart from the trommel 10 itself. The inner plates are connected along their edges 34.

Each inner plate 30 has a corresponding overlaid, flat, outer plate 36. Each outer plate includes a plurality of outer plate openings 38 having dimensions the same as the inner plate openings 32. In other words, each outer plate opening has four equal sides at right angles to form a square.

Figure 4:
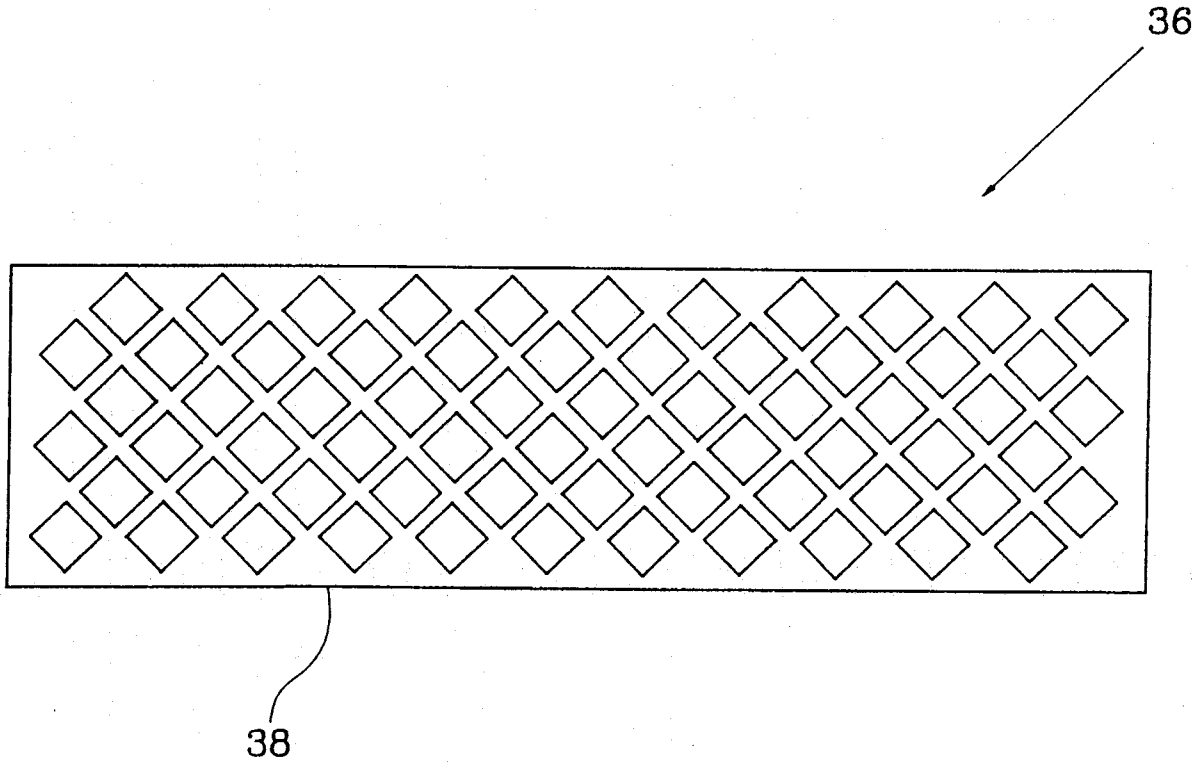
FIG. 4 is one of the outer plates shown apart from the adjustable orifice trommel in FIG. 1.

FIG. 4 illustrates an outer plate apart from the trommel. The outer plate openings 38 are likewise aligned so that in one orientation, the outer plate openings 38 mate with the inner plate openings 32 to form a plurality of orifices having the dimensions of the openings 32 and 38.

Figure 2:
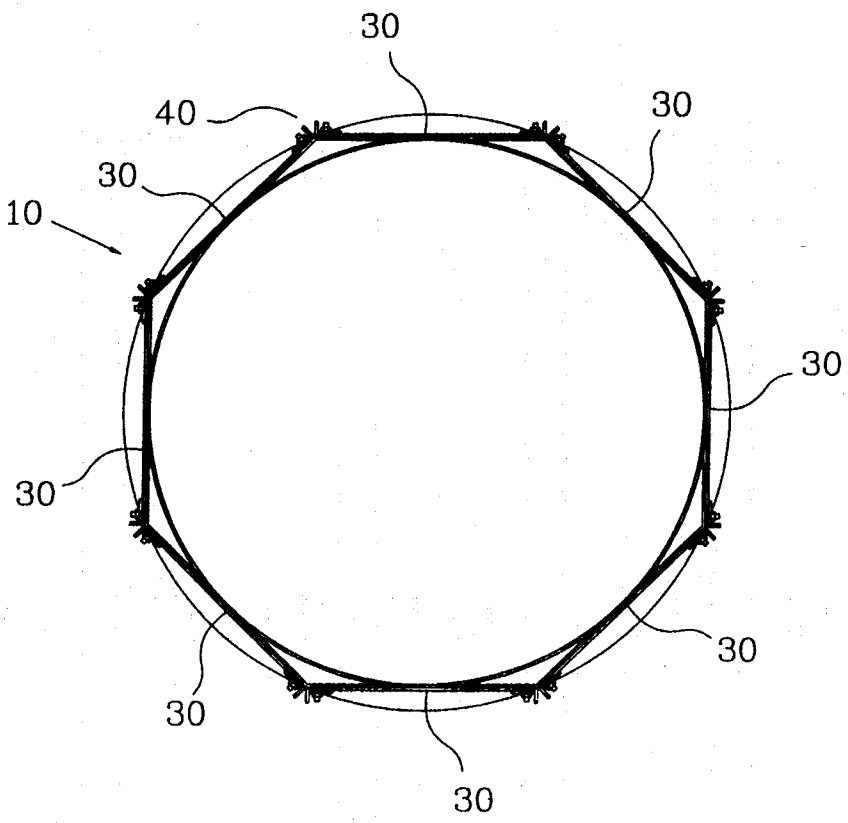
FIG. 2 is a sectional view of the adjustable orifice trommel shown in FIG. 1 taken along section line 2—2 of FIG. 1 with a portion enlarged.
Figure 2A:
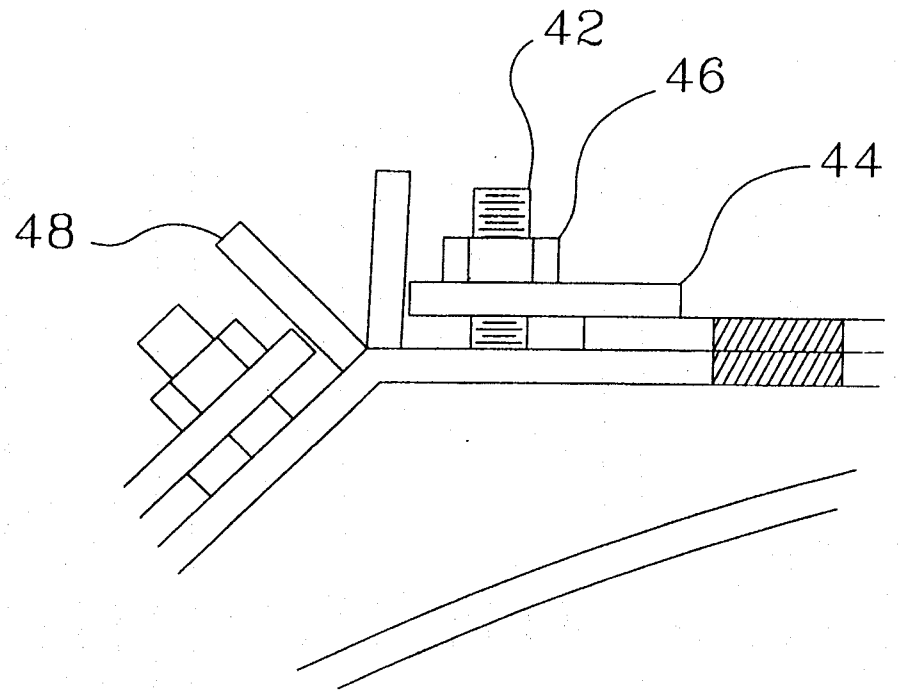

With reference to FIGS. 1 and 2, each outer plate 36 also has a mechanism 40 to slide the outer plate axially along the axis 14 of the body of the trommel. The mechanism to slide each outer plate includes a series of threaded posts 42 extending vertically from the inner plate. A clamp bar 44 having an opening fits over the post and is held in place by a nut 46. Once the outer plate 36 has been moved to a desired location, the outer plate may be locked in place with relation to the inner plate.

The openings 32 and 38 are arranged so that the sides of each opening are at a 45° angle to the direction of movement of the outer plate and the axis of the body.

In the present embodiment, each outer plate is allowed to slide axially in relation to the corresponding inner plate up to a maximum of two inches.

When the outer plate 36 is in position to form the largest opening, each side of the orifice opening is four inches in length. Accordingly, particulate matter having a diameter or having dimensions less than four inches will be allowed to filter or pass through the orifice openings and be separated out.

The orifice openings may be reduced in size so that only smaller particles will pass therethrough. When the outer plates are moved to form smaller orifice openings, each side of the openings is $2\frac{3}{4}$ inches long.

Figure 5:
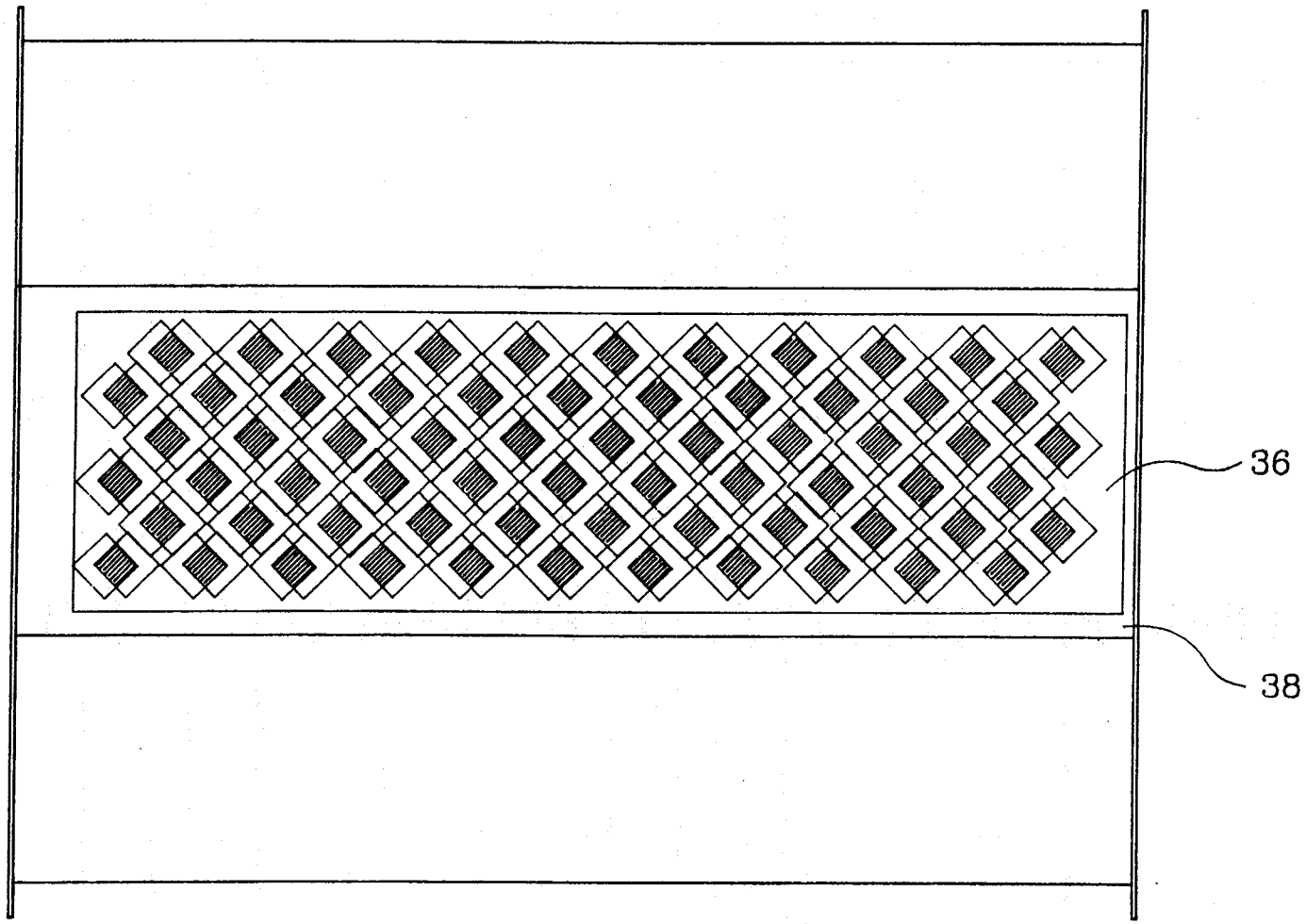
FIG. 5 is a depiction of a single inner plate and a single outer plate forming orifices for screening or filtering of material in the adjustable orifice trommel shown in FIG. 1.

FIG. 5 illustrates the outer plate 36 overlaid in position over the inner plate 30 with the outer plate moved so that the orifice size is at its smallest. The shaded areas show the resulting orifice. It will be observed that no matter what size the orifices are set for, they will be squares.

The outer plate will move with respect to the inner plate across the square openings from corner to corner.

It has been found that triangle-shaped openings having equal length sides or legs will also mate to form triangular orifices having equal sides or legs.

At the fully open position, with the orifices are at their largest openings, the trommel would have the greatest percentage of open area versus closed area. In one embodiment utilizing the present invention, approximately 40 percent open area is provided using an array of four inch square holes. The percentage of open areas will, of course, decrease as the orifices are made smaller.

Tumbling of the material is advantageous to present various parts of the material toward the orifices.

In many existing trommels, the interior body is a continuous cylinder having a smooth surface. Internally extending strike plates are provided so that the material will move against the strike plate as the body rotates and thereby be caused to tumble. It has been found that a series of discrete connected flat plates is superior to a cylindrical body since, as the body is rotated about its axis, the material to be screened will be caused to tumble by moving against the flat panels without use of strike plates.

By the use of the present invention, the orifices can be mechanically adjusted in simple and quick fashion to a desired size at the user's discretion, while the size of the orifices may be varied, they remain square shaped.

Whereas, the present invention has been described in relation to the drawings attached hereto, it should be understood that other and further modifications, apart from those shown or suggested herein, may be made within the spirit and scope of this invention.

What is claimed is:

1. An adjustable orifice trommel having an elongated body rotatable about an axis, an entry for insertion of particulate material and an exit for retrieving screened material, which trommel comprises:

means to rotate said elongated body about said axis including motor means to rotate at least one wheel which frictionally engages said elongated body;

a plurality of openings in said elongated body, each said body opening having four equal sides and four right angles and wherein said angles are adjacent to angles of an adjacent opening; and at least one outer portion slidable axially in relation to said body, each outer portion having a plurality of openings matable with said body openings so that moving said outer portion will vary the size of orifices formed with said orifices formed always having four equal sides and four right angles.

2. An adjustable orifice trommel having an elongated body rotatable about an axis, an entry for insertion of particulate material and an exit for retrieving screened material, which trommel comprises:

means to rotate said body about said axis including motor means to rotate at least one wheel which frictionally engages said elongated body;

a plurality of flat inner plates, each inner plate having a plurality of openings;

an outer plate for each inner plate slidable axially in relation to said inner plate, each outer plate having a plurality of openings matable with said inner plate openings so that moving said outer plate with respect to said inner plate will vary the size of orifices formed thereby wherein each said inner plate opening and each said outer plate opening has four equal sides and four right angles and wherein said angles are adjacent to angles of an adjacent opening; and said outer plate openings and said inner plate openings arranged so that said orifices formed will always have four equal sides and four right angles.

3. An adjustable orifice trommel as set forth in claim 2 including means to slide each said outer plate axially in relation to said inner plate.

4. An adjustable orifice trommel as set forth in claim 2 having eight said inner plates connected to each other and eight said outer plates forming an octagonal cross-section.

5. An adjustable orifice trommel as set forth in claim 2 wherein each said side of each said opening is at a 45° angle to the direction of movement of said outer plate.

6. An adjustable orifice trommel having an elongated body rotatable about an axis, an entry for insertion of particulate material and an exit for retrieving screened material, which trommel comprises:

means to rotate said body about said axis including motor means to rotate at least one wheel which frictionally engages said elongated body;

a plurality of flat inner plates, each inner plate having a plurality of openings;

an outer plate for each inner plate slidable axially in relation to said inner plate, each outer plate having a plurality of openings matable with said inner plate openings so that moving said outer plate with respect to said inner plate will vary the size of orifices formed thereby;

wherein each said inner plate opening and each said outer plate opening has three equal sides and three equal angles and wherein said angles are adjacent to angles of an adjacent opening; and said outer plate openings and said inner plate openings arranged so that said orifices formed will always have three equal sides and three equal angles.

7. An adjustable orifice trommel as set forth in claim 6 including means to slide each said outer plate axially in relation to said inner plate.

* * * * *